US005344582A

United States Patent [19]

Umemoto et al.

[11] Patent Number: 5,344,582

[45] Date of Patent: Sep. 6, 1994

[54] TRACTION FLUID DERIVED FROM CYCLOPENTADIENE OLIGOMERS

[75] Inventors: Noboru Umemoto, Kamifukuoka; Takeshi Nomura; Toshiaki Kuribayashi, both of Tsurugashima; Takehisa Sato, Saitama; Hirotaka Tomizawa, Tokorozawa, all of Japan

[73] Assignee: Tonen Corporation, Japan

[21] Appl. No.: 921,131

[22] Filed: Jul. 29, 1992

[30] Foreign Application Priority Data

Jul. 31, 1991 [JP] Japan ..... 3-214574

[51] Int. Cl.[5] ..... C10M 105/02; C10M 105/04

[52] U.S. Cl. ..... 252/9; 252/73; 252/11; 585/10; 585/21; 585/255; 585/259; 585/317

[58] Field of Search ..... 252/9, 73, 11, ; 585/10, 13, 21, 259, 255, 317

[56] References Cited

U.S. PATENT DOCUMENTS

| | | | |
|---|---|---|---|
| 3,440,894 | 4/1969 | Hammann et al. | 252/73 |
| 3,608,385 | 9/1971 | Duling et al. | 252/73 |
| 3,836,596 | 9/1974 | Hayashida et al. | 585/510 |
| 3,966,624 | 6/1976 | Duling et al. | 252/73 |
| 4,023,980 | 5/1977 | Prillieux et al. | 585/13 |

FOREIGN PATENT DOCUMENTS

| | | |
|---|---|---|
| 0207776 | 1/1987 | European Pat. Off. . |
| 0402881 | 12/1990 | European Pat. Off. . |
| 3834622 | 4/1990 | Fed. Rep. of Germany . |
| 2171988 | 9/1973 | France . |
| 1-197594 | 8/1989 | Japan . |
| 1-230696 | 9/1989 | Japan . |
| 1190836 | 5/1970 | United Kingdom . |

OTHER PUBLICATIONS

Patent Abstracts of Japan, vol. 15, No. 289, Jul. 1991.
Patent Abstracts of Japan, vol. 11, No. 13, Jan. 1987.
Database WPIL Week 8633, AN 86-216182, Jul. 1986.

*Primary Examiner*—Prince Willis, Jr.
*Assistant Examiner*—Alan D. Diamond
*Attorney, Agent, or Firm*—Lorusso & Loud

[57] ABSTRACT

A traction fluid lubricant is disclosed which contains a naphthenic ingredient having a weight average molecular weight of 200–300 and obtained by hydrogenating oligomers of cyclopentadiene having a ratio of the number of norbornenic double bond to that of cyclopentenic double bond of smaller than 0.9 but not smaller than 0.1. The naphthenic ingredient is suitably used in conjunction with an auxiliary ingredient selected from a polybutene having a viscosity of 5–60 cSt at 40° C. and a bicyclohexyl compound.

3 Claims, 1 Drawing Sheet

TRACTION FLUID DERIVED FROM CYCLOPENTADIENE OLIGOMERS

This invention relates to a traction fluid.

Traction fluid is a term used to identify a class of lubricants that give improved performance in traction drive. More particularly, traction fluid is used in a device, such as a non-stage transmission device for automobiles, in which traction drive transfers force from one rotating rigid body to another through rolling contact. The traction fluid is applied to such a contact portion to efficiently transmit the driving force and to prevent direct contact between the rigid bodies. Namely, such a traction fluid exhibits an increased viscosity upon being pressed by the rigid bodies to efficiently transfer the drive force with minimum slip but shows suitable fluidity immediately upon being released from the contact portion.

One of the important characteristics of traction fluid is the coefficient of traction. The higher the traction coefficient, the better becomes the transfer of drive force. With a traction fluid with a high traction coefficient, the traction drive device can be made compact. Another desirable property of traction fluid is viscosity thereof. Too high a viscosity causes a loss of energy for the stirring of the fluid and is disadvantageous because the fluid fails to exhibit required characteristics at the start of the operation in which the fluid is still cold. When the viscosity is considerably low, a liquid film is failed to be formed between the contact portion of the rolling members at a high temperature, causing seizure. Resistance to heat and oxidation is also required for traction fluids similar to ordinary lubricants.

JP-A-1-230696 proposes a traction fluid which includes a product having a weight average molecular weight of 250 or more and obtained by hydrogenating a polymer of dicyclopentadiene and/or dihydrodicyclopentadiene.

JP-A-l-197594 discloses a traction fluid including, as a basestock, a product which contains trimers to hexamers of cyclopentadiene as a major ingredient, which has a dynamic viscosity at 40° C. of 1–200 cSt and which is obtained by hydrogenating a cyclopentene-type, condensed hydrocarbon containing at least one polymer obtained by thermally polymerizing cyclopentadienes such that the ratio (ND/CD) of the amount of norbornenic double bond to the amount of cyclopentenic double bond is in the range of 0.9–1.3.

These known traction fluids are, however, not fully satisfactory in traction properties such as coefficient of traction and viscosity.

The present invention has been made to provide an improved traction fluid having both a high traction coefficient and suitable viscosity. In accordance with one aspect of the present invention, there is provided a traction fluid comprising a naphthenic ingredient having a weight average molecular weight of 200–300 and obtained by hydrogenating oligomers of cyclopentadiene having a ratio of the number of the norbornenic double bond to that of the cyclopentenic double bond of smaller than 0.9 but not smaller than 0.1, and an auxiliary ingredient selected from the group consisting of a polybutene having a viscosity of 5–60 cSt at 40° C., a compound expressed by the general formula (I) and mixtures thereof:

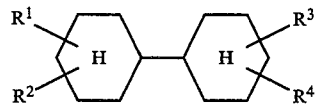

(I)

wherein $R^1$ through $R^4$ represent independently from each other a hydrogen atom, a methyl group or an ethyl group.

In another aspect, the present invention provides a traction fluid comprising a naphthenic ingredient having a weight average molecular weight of lower than 250 but not lower than 200 and obtained by hydrogenating oligomers of cyclopentadiene having a ratio of the number of the norbornenic double bond to that of the cyclopentenic double bond of smaller than 0.9 but not smaller than 0.1.

BRIEF DESCRIPTION OF THE DRAWING

The present invention will now be described in detail below with reference to the accompanying drawings in which the sole FIGURE is a graph showing a relationship between the coefficient of traction and the mixing ratio of polybutene to naphthenic ingredient of the traction fluids according to the present invention.

In the present invention, a naphthenic ingredient having a weight average molecular weight of 200–300 and obtained by hydrogenating a mixture of cyclopentadiene oligomers is used as an essential ingredient. The oligomers have a ratio of the number of the norbornenic double bond to that of the cyclopentenic double bond of smaller than 0.9 but not smaller than 0.1, preferably in the range of between 0.3 and 0.6.

Figure 1:
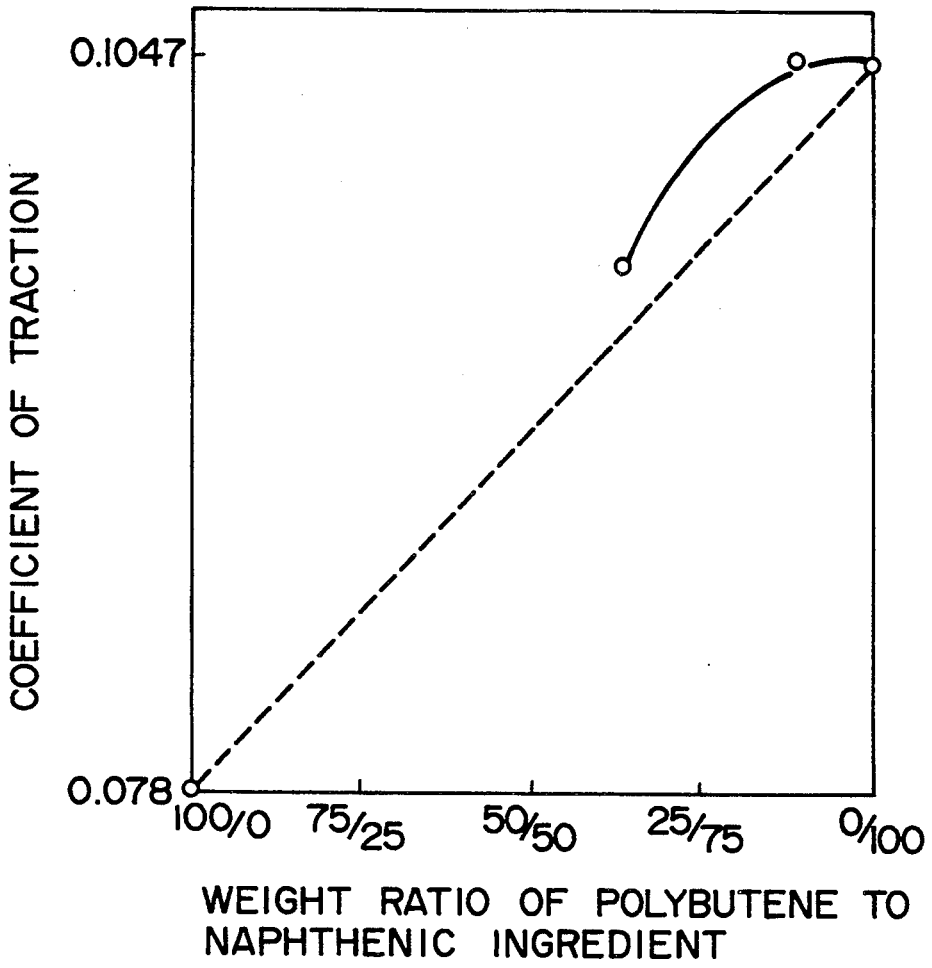

It is important that the naphthenic ingredient has a weight average molecular weight of 200–300. When the average molecular weight exceeds 300, high coefficient of traction cannot be obtained. Too small a weight average molecular weight below 200 is also undesirable because of the same reason as above. Preferably, the naphthenic ingredient has a weight average molecular weight of lower than 250 but not lower than 200. It is preferred that the naphthenic ingredient contain hydrogenated trimers and/or hydrogenated tetramers of cyclopentadiene as a major component thereof. In particular, the total amount of the hydrogenated trimers and tetramers in the naphthenic ingredient is preferably at least 70% by weight, more preferably at least 75% by weight.

Illustrative of hydrogenated tetramers are as shown by the formulas (II)–(VI):

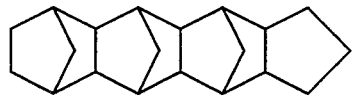

(II)

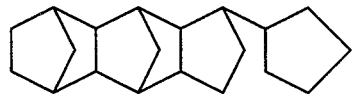

(III)

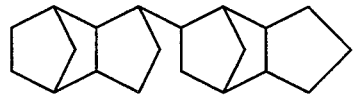

(IV)

-continued (V)

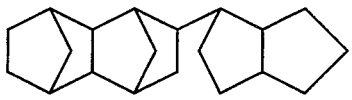

(VI)

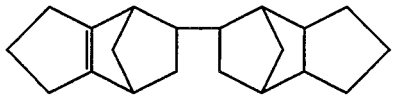

The compound (II) is a product resulting from successive Dieis-Alder reaction of cyclopentadiene, followed by hydrogenation. The compounds (III)–(VI) are hydrogenated products of tetramers of cyclopentadiene formed through ordinary addition reaction as well as Dieis-Alder reaction. Hydrogenated trimers have structures similar to (II)–(VI) except that one of the rings thereof is not present. The non-hydrogenated precursor of the compound (VI) has a ratio of the norbornenic double bond to the cyclopentenic double bond of 0. The naphthenic ingredient to be used in the present invention is relatively rich in trimer and tetramers similar to the compounds (III)–(VI) and, for this reason, the traction fluid of the present invention is considered to exhibit high coefficient of traction.

The above naphthenic ingredient may be produced in any known manner. For example, cyclopentadiene-containing raw material feed is reacted at a temperature of 160°–300° C. for 0.1–10 hours in the presence or absence of a solvent in an inert gas atmosphere to obtain a product containing cyclopentadiene oligomers. If desired, the thermal polymerization may be further continued after the removal of unreacted raw materials and the solvent. The reaction conditions are controlled so that the oligomer product has one or more norbornen rings and one or more cyclopentene rings in such a proportion that the ratio of the number of the norbornenic double bonds to that of the cyclopentenic double bonds is smaller than 0.9 but not smaller than 0.1. This ratio may be determined by proton NMR analysis. The raw material feed is preferably a cyclopentadiene fraction obtained by steam cracking of naphtha and containing at least 30% by weight of cyclopentadiene.

The oligomer product is then subjected to a hydrogenation treatment. The hydrogenation may be carried out by, for example, contacting the oligomer product with a hydrogenation catalyst, such as a nickel, palladium or platinum catalyst, at a temperature of 70°–300° C. under a hydrogen pressure of 10–200 kg/cm$^2$ for 0.5–20 hours in the presence or absence of a solvent. The hydrogenated product which contains hydrogenated oligomers, petroleum resins and others is then subjected to a separation treatment to isolate the hydrogenated oligomers. The oligomers thus obtained may be used as such for the preparation of the traction fluid. If desired, the hydrogenated oligomer product may be distilled to obtain a high boiling point fraction (boiling point of 150°–180° C. at 2 mmHg) and a low boiling point fraction (boiling point of 110°–150° C. at 2 mmHg). These fractions are blended in a suitable blending ratio to obtain the naphthenic ingredient having a desired viscosity.

The above naphthenic ingredient is used in conjunction with an auxiliary ingredient selected from a polybutene having a viscosity of 5–60 cSt at 40° C., a compound expressed by the general formula (I) and mixtures thereof:

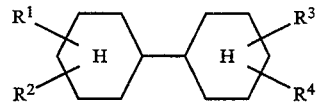

(I)

wherein $R^1$ through $R^4$ represent independently from each other a hydrogen atom, a methyl group or an ethyl group.

The term "polybutene" used herein is intended to include hydrogenated derivatives thereof. The polybutene is preferably poly(isobutylene) having the following formula (VII):

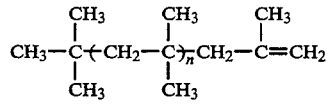

(VII)

wherein n represents the degree of polymerization and is a number providing a viscosity at 40° C. of 5–60 cSt. Hydrogenated poly(isobutylene) having the formula (VIII) is also preferably used:

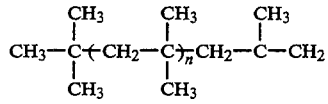

(VIII)

It is important that the polybutene to be blended with the naphthenic ingredient have a viscosity of 5–60 cSt at 40° C. When the viscosity is lower than 5 cSt, the resulting traction fluid is poor in thermal stability and oxidation stability. On the other hand, a viscosity higher than 60 cst causes a problem because the traction fluid cannot show adequate viscosity.

The conjoint use of the naphthenic ingredient and the polybutene provides the following effects. Firstly, the traction fluid exhibits suitable viscosity of 10–80 cSt at 40° C., more desirably 10–60 cSt at 40° C. Secondly, the traction fluid unexpectedly shows a coefficient of traction higher than those obtained when the naphthenic ingredient and the polybutene are used by themselves. For reasons of obtaining such a synergistic effect and a suitable viscosity, it is preferred that the blending ratio of the polybutene to the naphthenic ingredient be 5:95 to 70:30, more preferably 5:95 to 65:35.

Another auxiliary ingredient to be used together with the naphthenic ingredient is a bicyclohexyl compound of the formula (I). Preferably, two of the four substitutents $R^1$ through $R^4$ of the compound (I) represent hydrogen. Examples of suitable bicyclohexyl compounds include bicyclohexyl, ethylbicyclohexyl, diethylbicyclohexyl and triethylbicyclohexyl.

The conjoint use of the naphthenic ingredient and the bicyclohexyl compound can give an improvement in traction coefficient, viscosity and oxidation stability. Furthermore, the bicyclohexyl compound can prevent the loss of the traction fluid by vaporization during use. The mixing ratio of the bicyclohexyl compound to the naphthenic ingredient is generally 5:95 to 50:50, preferably 10:90 to 50:50. If desired, the bicyclohexyl compound may be used together with the polybutene.

It has been found that the above-described naphthenic ingredient can give desired traction properties and viscosity without the auxiliary ingredient so far as the weight average molecular weight thereof is lower than 250 but not lower than 200, though the use thereof in conjunction with the auxiliary ingredient is more preferred.

The traction fluid according to the present invention can contain known additives such as an anti-oxidant, a viscosity index improver, a metal deactivator, an anti-wear agent, a rust preventing agent and anti-foaming agent. Further, if desired, other conventional lubricants, such as paraffinic mineral oils, naphthenic mineral oils and hydrocarbon oils and oxygen-containing liquids such as esters and ethers, may be incorporated into the traction fluid of the present invention.

The following examples will further illustrate the present invention.

EXAMPLE 1

63 Parts by weight of a naphthenic ingredient having a weight average molecular weight of 280 and containing 84% by weight of hydrogenated tetramers of cyclopentadiene (balance being hydrogenated trimers, pentamers and other oligomers) was mixed with 37 parts by weight of polyisobutylene (POLYBUTENE NAS-5H manufactured by Nihon Yushi K. K.) having a viscosity of 11.0 cSt at 40° C. to obtain a traction fluid. The naphthenic ingredient was a product obtained by hydrogenating a mixture of oligomers of cyclopentadiene having a ratio of the amount of norbornenic double bond to the amount of cyclopentenic double bond of 0.59. The traction fluid was then measured for its viscosity (according to JIS K 2283), viscosity index, thermal stability (JIS K 2540), oxidation stability (JIS K 2514) and coefficient of traction. The coefficient of traction was measured as follows. A Soda-type, four-roller traction tester is employed. The test conditions involve an oil temperature of 30° C., a roller temperature of 30° C., an average Hertzian pressure of 1.2 GPa, a rolling speed of 3.6 m/s and slip ratio of 3.0%. These conditions generally give maximum value of coefficient of traction. The thermal stability and the oxidation stability of the traction fluid were excellent. The other results were as summarized in Table 1.

EXAMPLE 2

85 Parts by weight of a naphthenic ingredient having a weight average molecular weight of 231 and containing 36% by weight of hydrogenated tetramers of cyclopentadiene 60% by weight of hydrogenated trimers of cyclopentadiene (balance being pentamers and other oligomers) was mixed with 15 parts by weight of the above polyisobutylene to obtain a traction fluid. The naphthenic ingredient was a product obtained by hydrogenating a mixture of oligomers of cyclopentadiene having a ratio of the amount of norbornenic double bond to the amount of cyclopentenic double bond of 0.30. The traction fluid was then measured for its physical properties in the same manner as that in Example 1. The thermal stability and the oxidation stability of the traction fluid were excellent. The other results were as summarized in Table 1.

COMPARATIVE EXAMPLE 1-3

Traction fluids were prepared by mixing polybutenes and naphthenic ingredients as shown in Table 1 with a blending ratio as shown in Table 1. The thus obtained traction fluids were tested for their physical properties in the same manner as that in Example 1. The thermal stability and the oxidation stability of the traction fluids are found to be excellent. The other results were as summarized in Table 1.

In Examples 1 and 2 and Comparative Examples 1-3, the polybutene/naphthenic ingredient mixing ratio is so selected as to give a suitable viscosity of 20-25 cSt at 40° C.

COMPARATIVE EXAMPLE 4

Traction fluids were prepared by mixing polybutene having a viscosity at 40° C. of 5 cSt with each of the naphthenic ingredients used in Examples 1 and 2 and Comparative Examples 1-3. The resulting traction fluids are found to be poor in thermal stability and in oxidation stability.

COMPARATIVE EXAMPLE 5

Traction fluids were prepared by mixing polybutene having a viscosity at 40° C. of 60 cSt with each of the naphthenic ingredients used in Examples 1 and 2 and Comparative Examples 1-3. None of the resulting traction fluids show a desired viscosity in the range of 10-80 cSt at 40° C.

COMPARATIVE EXAMPLES 3-5

Traction fluids were prepared by mixing polybutenes and naphthenic ingredients as shown in Table 1 with a blending ratio as also shown in Table 1. The naphthenic ingredient used in Example 4 is the same as that used in Example 1. The naphthenic ingredient used in each of Examples 3 and 5 contained 75% by weight of hydrogenated tetramers of cyclopentadiene (balance being hydrogenated trimers, pentamers and other oligomers) and was a product obtained by hydrogenating a mixture of oligomers of cyclopentadiene having a ratio of the amount of norbornenic double bond to the amount of cyclopentenic double bond of 0.41. The thus obtained traction fluids were tested for their physical properties in the same manner as that in Example 1. The thermal stability and the oxidation stability of the traction fluids are found to be excellent. The other results were as summarized in Table 1.

TABLE 1

| Example No. | Viscosity of Polybutene at 40° C. (cSt) | Weight Average Molecular Weight of Naphthenic Ingredient | Polybutene/ Naphthenic Ingredient Mixing Ratio | Physical Properties of Traction Fluid | | | |
|---|---|---|---|---|---|---|---|
| | | | | Viscosity at 40° C. (cSt) | Viscosity at 100° C. (cSt) | Viscosity Index | Coefficient of Traction |
| 1 | 11.0 | 280 | 37:63 | 24.5 | 4.06 | 25.1 | 0.0958 |
| 2 | 11.0 | 231 | 15:85 | 23.3 | 4.09 | 50.3 | 0.0985 |
| Comp. 1 | 11.0 | 340 | 87:13 | 21.0 | 3.98 | 71.9 | 0.0818 |
| Comp. 2 | 11.0 | 425 | 90:10 | 20.4 | 3.79 | 51.7 | 0.0820 |
| Comp. 3 | 21.0 | 195 | 85:15 | 20.2 | 3.77 | 51.5 | 0.0821 |
| 3 | 11.3 | 260 | 33:67 | 23.5 | 3.69 | −31.7 | 0.0943 |
| 4 | 31.0 | 280 | 41:59 | 52.8 | 6.65 | 68.5 | 0.0927 |

TABLE 1-continued

| Example No. | Viscosity of Polybutene at 40° C. (cSt) | Weight Average Molecular Weight of Naphthenic Ingredient | Polybutene/ Naphthenic Ingredient Mixing Ratio | Physical Properties of Traction Fluid: Viscosity at 40° C. (cSt) | Viscosity at 100° C. (cSt) | Viscosity Index | Coefficient of Traction |
|---|---|---|---|---|---|---|---|
| 5 | 31.0 | 260 | 38:62 | 51.0 | 6.16 | 46.4 | 0.0921 |

EXAMPLE 6

A naphthenic ingredient having a weight average molecular weight of 280 and containing 84% by weight of hydrogenated tetramers of cyclopentadiene (balance being hydrogenated trimers, pentamers and other oligomers) was mixed with polyisobutylene having a viscosity of 11 cSt at 40° C. with various blending ratios. The naphthenic ingredient was a product obtained by hydrogenating a mixture of oligomers of cyclopentadiene having a ratio of the amount of norbornenic double bond to the amount of cyclopentenic double bond of 0.59. The coefficient of traction of each of the thus obtained traction fluids was measured to give the results shown in FIG. 1. The conjoint use of the naphthenic ingredient and the polybutene gives a synergistic effect.

EXAMPLE 7

A mixture of cyclopentadiene oligomers having a ratio of the amount of norbornenic double bond to the amount of cyclopentenic double bond of 0.43 was hydrogenated to obtain a naphthenic ingredient. The thus obtained naphthenic ingredient was subjected to fractional distillation to obtain Fractions A and B whose physical properties and compositions were as shown in Table 2.

TABLE 2

| Fraction | Physical Properties: Viscosity at 40° C. (cSt) | Viscosity at 100° C. (cSt) | Viscosity Index | Composition (wt. %): Trimer | Tetramer | Others |
|---|---|---|---|---|---|---|
| A | 10.25 | 2.63 | 82.9 | 96.8 | 3.2 | none |
| B | 255.0 | 11.26 | −89.6 | 0.1 | 99.2 | 0.7 |

The Fraction A (53 parts by weight) was blended with the Fraction B (47 parts by weight) to obtain a traction fluid having a viscosity at 40° C. of 23.36, a viscosity at 100° C. of 4.07, a viscosity index of 46.5, a weight average molecular weight of 238 and a coefficient of traction of 0.1010. The thermal stability and the oxidation stability of the traction fluid are found to be excellent.

EXAMPLE 8–12

The Fractions A and B obtained in Example 7 were blended with the blending ratios shown in Table 3 to obtain naphthenic ingredients having physical properties as shown in Table 3. Each of the naphthenic ingredients was then mixed with an additive (bicyclohexyl (BCH), ethylbicyclohexyl (EBCH) or triethylbicyclohexyl (TBCH)) as shown in Table 3 with the mixing ratio shown in Table 3 to obtain a traction fluid whose properties are also summarized in Table 3. In Table 3, the weight loss is measured as follows: Sample ($W_0$ g) is heated at 120° C. and maintained at that temperature for 5 hours. Thereafter, the weight (W1) of the sample is measured. The weight loss is defined by the following equation:

$$\text{Weight Loss (\%)} = (W_0 - W_1)/W_0 \times 100$$

It will be apparent from the results shown Tables 1 and 3 and FIG. 1, that the traction fluids according to the present invention exhibit a high coefficient of traction and, at the same time, have a suitable viscosity.

TABLE 3

| Example | Naphthenic Ingredient: Blending Ratio of Fraction A:B | Viscosity at 40° C. (cSt) | Weight Average M.W. | Amount (parts by weight) | Additive: Compound | Amount (parts by weight) | Physical Properties of Traction Fluid: Viscosity at 40° C. (cSt) | Coefficient of Traction | Weight Loss (wt. %) |
|---|---|---|---|---|---|---|---|---|---|
| 8 | 30:70 | 65.90 | 247 | 83 | BCH | 17 | 24.89 | 0.0987 | 46 |
| 9 | 30:70 | 65.90 | 247 | 80 | EBCH | 20 | 26.72 | 0.0986 | 45 |
| 10 | 0:100 | 255.0 | 268 | 70 | BCH | 30 | 22.84 | 0.1008 | 42 |
| 11 | 30:70 | 65.90 | 247 | 50 | TBCH | 50 | 25.59 | 0.0935 | 40 |
| 12 | 64:36 | 25.97 | 226 | 100 | — | 0 | 25.97 | 0.0977 | 65 |

What is claimed is:

1. A traction fluid comprising a naphthenic ingredient having a weight average molecular weight of lower than 250 but not lower than 200 and obtained by hydrogenating oligomers of cyclopentadiene having a ratio of the number of the norbornenic double bonds to that of the cyclopentenic double bonds in the range of between 0.3 and 0.6.

2. A traction fluid comprising a naphthenic ingredient having a weight average molecular weight of 200–300 and containing at least 70% by weight of hydrogenated trimers and tetramers, said naphthenic ingredient being obtained by hydrogenating oligomers of cyclopentadiene having a ratio of the number of norbornenic double bonds to that of cyclopentenic double bonds of between 0.03 and 0.6, and an auxiliary ingredient selected from the group consisting of a polybutene in an amount of 5–70%, based on the total weight of said polybutene and said naphthenic ingredient, said polybutene having a viscosity of 5–60 cSt at 40° C., a compound expressed by the general formula (I);

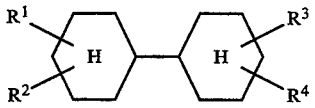

(I)

wherein $R^1$ through $R^4$ represent independently from each other a hydrogen atom, a methyl group or an ethyl group, said compound of the formula (I) being present in an amount of 5–50% based on the total weight of said compound of the formula (I) and said napththenic ingredient; and mixtures thereof.

3. A traction fluid as claimed in claim 1 wherein said naphthenic ingredient has a weight average molecular weight of lower than 250 but not lower than 200.

* * * * *

UNITED STATES PATENT AND TRADEMARK OFFICE

CERTIFICATE OF CORRECTION

PATENT NO. : 5,344,582

DATED : September 6, 1994

INVENTOR(S) : UMEMOTO et al

It is certified that error appears in the above-indentified patent and that said Letters Patent is hereby corrected as shown below:

Col. 3, line 13, delete "Dieis" insert --Diels--; and line 18, delete "Dieis" insert --Diels--.

Col. 6, line 39, delete "COMPARATIVE".

Col. 8, line 68, delete the semicolon ";" and insert a colon --:--.

Signed and Sealed this

Nineteenth Day of December, 1995

*Attest:*

*Attesting Officer*

Bruce Lehman

BRUCE LEHMAN

*Commissioner of Patents and Trademarks*